US007139508B2

(12) United States Patent
Okamoto

(10) Patent No.: US 7,139,508 B2
(45) Date of Patent: Nov. 21, 2006

(54) IMAGE FORMING CARTRIDGE AND IMAGE FORMING APPARATUS

(75) Inventor: Keiji Okamoto, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/047,925

(22) Filed: Feb. 2, 2005

(65) Prior Publication Data

US 2005/0169665 A1 Aug. 4, 2005

(30) Foreign Application Priority Data

Feb. 2, 2004 (JP) ..... 2004-026037

(51) Int. Cl.
*G03G 15/08* (2006.01)

(52) U.S. Cl. ..... 399/111; 399/112

(58) Field of Classification Search ..... 399/111, 399/107, 110, 112, 113, 114; 347/115
See application file for complete search history.

(56) References Cited

U.S. PATENT DOCUMENTS 6,453,135 B1 9/2002 Sameshima et al.
6,798,430 B1 * 9/2004 Sato ..... 347/115
2003/0077084 A1 * 4/2003 Cornelius ..... 399/12
2003/0228173 A1 * 12/2003 Nittani et al. ..... 399/222
2005/0244188 A1 * 11/2005 Sato et al. ..... 399/114

FOREIGN PATENT DOCUMENTS

JP 06-332304 * 12/1994
JP 09-171338 6/1997
JP 2003-084646 3/2003

* cited by examiner

*Primary Examiner*—Hoan Tran
(74) *Attorney, Agent, or Firm*—Oblon, Spivak, McClelland, Maier & Neustadt, P.C.

(57) ABSTRACT

An image forming apparatus including first and second image forming cartridges. Both of the first and second image forming cartridges has at least one handle. The handle of the first image forming cartridge is formed at a different position in line with the handle of the second image forming cartridge.

22 Claims, 6 Drawing Sheets

IMAGE FORMING CARTRIDGE AND IMAGE FORMING APPARATUS

BACKGROUND OF THE INVENTION

1. Field of the Invention

The present invention generally relates to an image forming cartridge and an image forming apparatus using the same, and more particularly to an image forming cartridge for forming images in a copying apparatus, a facsimile apparatus, a printer or the like, by an electrostatic image transfer process or an ink jet type image forming process, and to an image forming apparatus which uses such a image forming cartridge.

2. Description of the Background Art

An image forming apparatus of the type using an electrostatic image transfer system or an ink jet type image forming system is conventional and configured to form an image on a recording medium, e.g. a paper, a sheet or any recording medium. Such image forming apparatuses utilize an image forming cartridge, which collectively may have a photoconductive drum, a charging device, a developing device, a cleaning device, or the like, and which is detachably mounted in the image forming apparatus.

By using an image forming cartridge as above, it is easy to maintain the image forming apparatus because the image forming cartridge can be replaced with a new one if maintenance is required. Also, a user or a service person can maintain it.

In general, an image forming cartridge is made of parts having similar life cycles, e.g. a developing cartridge collectively mounting a toner accommodating portion and a developing device, a photoconductive drum cartridge collectively mounting a photoconductive drum, a charging device, and a cleaning device.

Particularly, a current trend in the imaging art is toward a tandem image forming apparatus that assigns a particular image carrier to each color in order to meet the increasing demand for high-speed color image formation. The tandem image forming apparatus includes a plurality of image forming cartridges each with a photoconductive drum, e.g. in a vertical or horizontal direction.

Another current trend is an increase in demand to reuse an image forming cartridge after the image forming cartridge is used up so that environmental disposal problems are prevented.

In a tandem image forming apparatus as above, a plurality of image forming cartridges are mounted inside an image forming apparatus. Therefore there is also a strong demand towards downsizing the image forming cartridge as much as possible so that a size of the image forming apparatus is small.

To solve the problem stated above, Japanese Laid-open publication No. 09-171338 describes a cartridge with a handle for which a user can easily grasp the cartridge for maintenance.

Also, Japanese Laid-open publication No. 2003-84646 describes an image forming apparatus having a plurality of process cartridges each with a handle in line.

Further, Japanese Laid-open publication No. 06-332304 describes a process cartridge with a handle, which is detachably installed on the process cartridge. The same handle can be installed in a developing unit, a cartridge, or a front cover.

FIG. 8 is an example showing a drawing of a related art image forming apparatus 150, and FIG. 9 is a top view of the image forming apparatus 150. The image forming apparatus 150 has a plurality of image forming cartridges, i.e. an image forming cartridge 100BK for black, an image forming cartridge 100C for cyan, an image forming cartridge 100M for magenta, and an image forming cartridge 100Y for yellow. These image forming cartridges 100BK, 100C, 100M, and 100Y are horizontally mounted in an image forming portion 151 of image forming apparatus 150. Also, FIG. 10 is another example showing a side view of an image forming apparatus 160, having a plurality of image forming cartridges 100BK, 100C, 100M, and 100Y in a vertical direction, in an image forming portion 161 of image forming apparatus 160.

In both of the image forming apparatuses shown in FIG. 9 and FIG. 10, each image forming cartridge 100BK, 100C, 100M, and 100Y has handles positioned at both sides in a width of a paper path outside of each image forming cartridge. These handles are formed a line in a horizontal or vertical direction. Therefore, when an image forming cartridge is replaced with a new one, it may be hard for a user to grasp handles of the image forming cartridge.

SUMMARY OF THE INVENTION

It is an object of the present invention to provide an image forming apparatus improving a handling of an image forming cartridge mounted in the image forming apparatus, and an image forming cartridge for use in the same.

It is a further object of the present invention to provide a small-sized image forming apparatus in a direction of arrangement of a plurality of image forming cartridge, and an image forming cartridges for use in the same.

It is a further object of the present invention to provide a tandem image forming apparatus to form a color image by high-speed, and an image forming cartridge for use in the same.

It is a further object of the present invention to provide an image forming cartridge, which may be reused after the image forming cartridge is used up, at a lower cost, and an image forming apparatus mounting the same.

An image forming apparatus of the present invention includes first and second image forming cartridges. Both of the first and second image forming cartridges have a handle configured to be formed on each of the first and second image forming cartridges. The handle of the first image forming cartridge is formed at a different position than the handle of the second image forming cartridge.

An image forming cartridge of the present invention includes a handle to be formed on the image forming cartridge. The handle of the image forming cartridge is formed at a different position than a handle of an adjacent image forming cartridge.

BRIEF DESCRIPTION OF THE DRAWINGS

The above and other objects, features and advantages of the present invention will become more apparent from the following detailed description taken with the accompanying drawings in which.

DETAILED DESCRIPTION OF THE PREFERRED EMBODIMENTS

A preferred embodiment of the present invention is explained as below, referring to FIG. 1 to FIG. 5.

Figure 1:
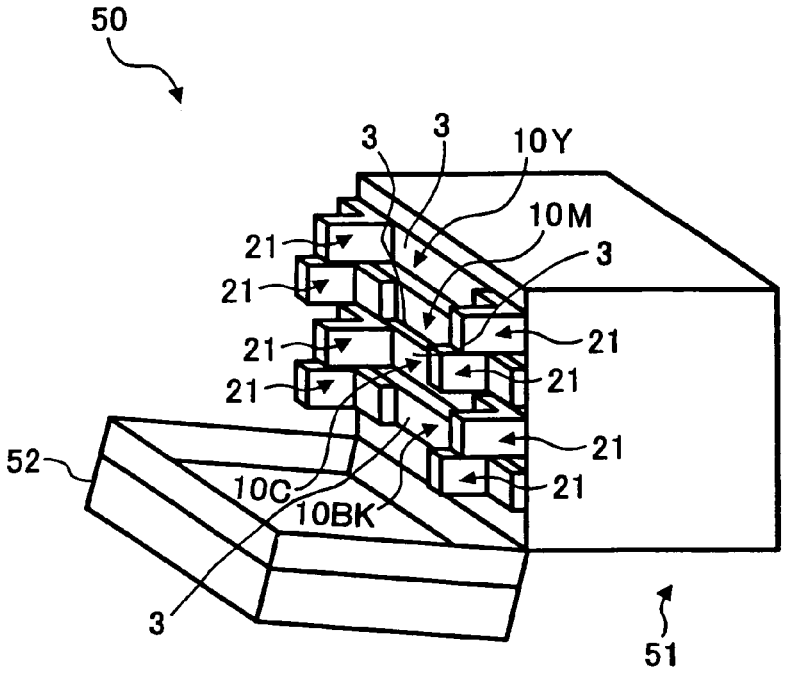
FIG. 1 is a perspective view showing an embodiment of an image forming apparatus vertically mounting a plurality of image forming cartridges according to the present invention.
Figure 2:
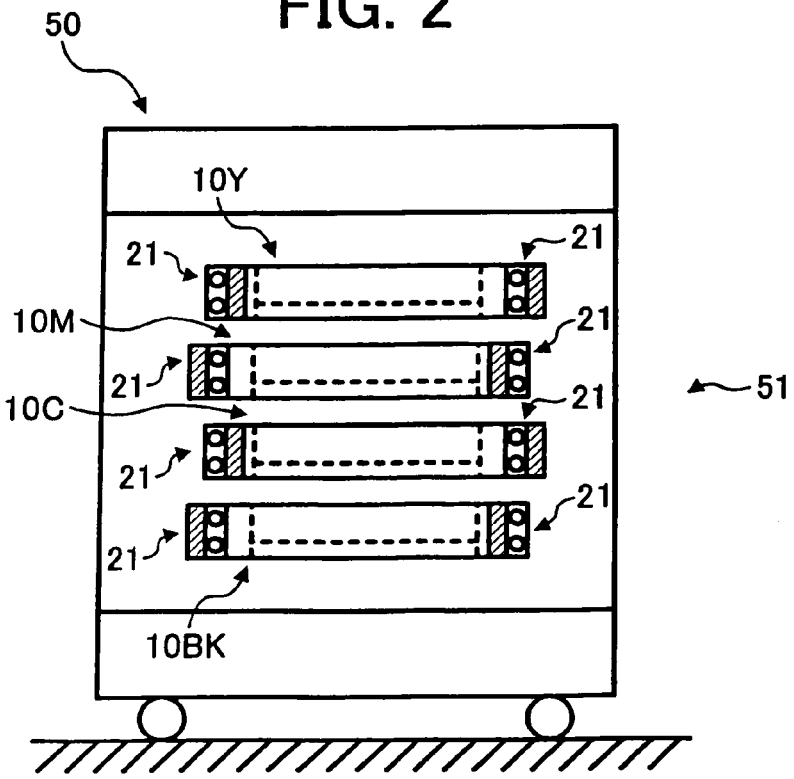
FIG. 2 is a side view showing the image forming apparatus shown in FIG. 1, which vertically mounts a plurality of image forming cartridges in the apparatus.

FIG. 1 is a perspective drawing of an image forming apparatus 50 of the type using an electrostatic image transfer system, which detachably mounts a plurality of image forming cartridges, namely an image forming cartridge 10BK for black (BK), an image forming cartridge 10C for cyan (C), an image forming cartridge 10M for magenta (M), and an image forming cartridge 10Y for yellow (Y), in a image forming portion 51 of the image forming apparatus 50. FIG. 2 is a side view of the image forming apparatus 50. The plurality of image forming cartridges is arranged in line in a vertical direction. When a cover 52 opens, the plurality of image forming cartridges can be replaced with new ones as a user or a service person maintains it.

Each image forming cartridge can have the same parts except for the color used to form a corresponding photoconductive drum 1, and a position of handles 21 detailed below, therefore one image forming cartridge 10 is explained below with the symbol indicating a color, BK, C, M and Y being omitted.

Figure 3:
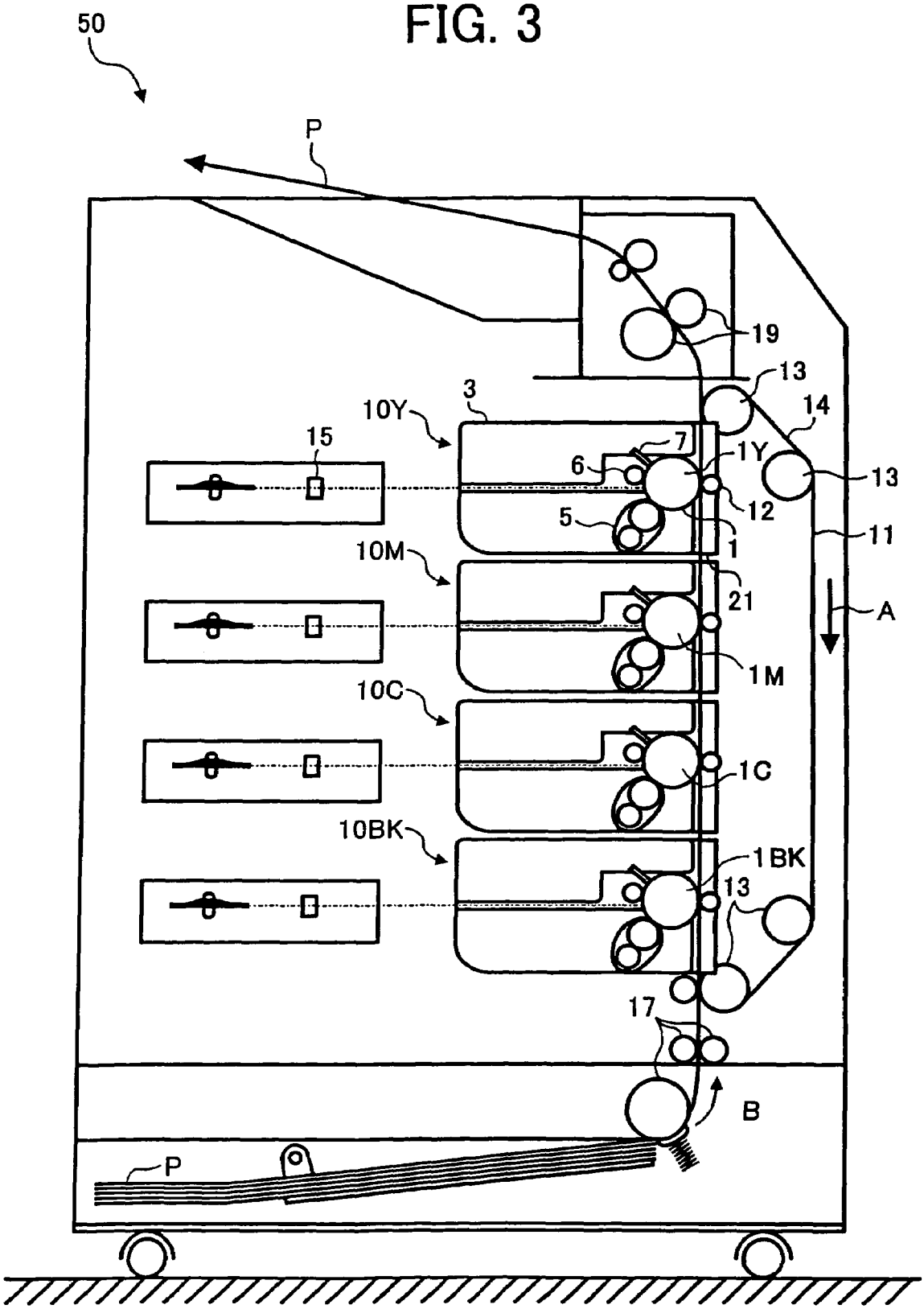
FIG. 3 is a cross sectional view showing the image forming apparatus shown in FIG. 1, which vertically mounts a plurality of image forming cartridges in the apparatus.

FIG. 3 is a sectional drawing of the image forming apparatus 50. As shown in FIG. 3, each image forming cartridge 10BK, 10C, 10M, and 10Y collectively includes a photoconductive drum 1 as an image bearing element, a developing device 5, a charging device 6 and a cleaning blade 7 as a cleaning device, in a cartridge body 3. The photoconductive drum 1 is rotatably mounted in the cartridge body 3 and can bear a latent image. The developing device 5, the charging device 6 and the cleaning blade 7 are mounted in the cartridge body 3 around the photoconductive drum 1.

In this embodiment, an image forming cartridge includes a photoconductive drum 1, a developing device 5, a charging device 6 and a cleaning device 7. It is preferable that the image forming cartridge has at least one device selected from a photoconductive drum 1, a developing device 5, a charging device 6, a cleaning device 7 and the like. Also, it is preferable that the image forming cartridge has the other device to form an image, e.g. a toner bottle accommodating a toner to supply to a developing device, an intermediate transferring medium to transfer an image from a photoconductive drum 1, an electricity removing device for removing electricity from a photoconductive drum 10 and the like.

The charging device 6 uniformly charges a surface of the photoconductive drum 1 to a preferable polarity. An exposing device 15 generates a light beam corresponding to each color image, on the photoconductive drum 1 so that a latent image is formed on the surface of the photoconductive drum 1. The developing device 5 can accommodate a toner corresponding to each developing device 5, and can develop the latent image at a developing area. The cleaning blade 7 contacts the photoconductive drum 1 and can remove a residual toner after transfer by a transferring roller 12 of a transferring device.

In the embodiment, the transferring device includes a plurality of transferring rollers 12 and a transfer belt 11. A transfer belt 11 is stretched by four supporting rollers 13 and can be rotated on contact with the photoconductive drums 1BK, 1C, 1M, and 1Y in a direction (A) shown in the FIG. 3. The transfer belt 12 can convey a recording medium, e.g. paper or a sheet from a cassette mounted a bottom of the image forming apparatus. The transfer belt 12 is mounted on a cover 52; therefore the image forming cartridges 10 can be exchanged after the cover 52 opens. Sheet feeding rollers 17 feed paper or a sheet as a recording medium from a cassette, which is mounted in the bottom of the image forming apparatus 50. The sheet (P) is fed in a direction (B) shown in the FIG. 3 and each image on the photoconductive drum 1BK, 1C, 1M, and 1Y can be collectively transferred on the paper of the sheet to form a color image. After being transferred, the image on the sheet of papers is fixed by heat and/or pressure generated by a fixing device 19, and then the sheet is discharged to the top of the image forming apparatus 50.

Referring again to FIG. 1 and FIG. 2, handles 21 are formed on a cartridge body 3 of an image forming cartridge 10 at a same side of an image forming apparatus 50 so that the plurality of image forming cartridges can be replaced by a user or a service person. In this embodiment, the handles 21 are alternately positioned as shown FIG. 1 and FIG. 2. However, it is possible that each handle 21 of the plurality of an image forming cartridges is formed at a different position on each image forming cartridge, i.e. handle 21 of an image forming cartridge is formed at a different position from another handle of an adjacent image forming cartridge, when an image forming cartridge is mounted in an image forming apparatus. Therefore, even if the plurality of image forming cartridges is mounted in a small pitch close to each other, the plurality of image forming cartridges can be easily grabbed or grasped by a user when the image forming cartridge has to be replaced. Also, since it is not necessary to have a lot of space for handling of the image forming cartridges, the image forming apparatus is downsized in a vertical direction.

Figure 4:
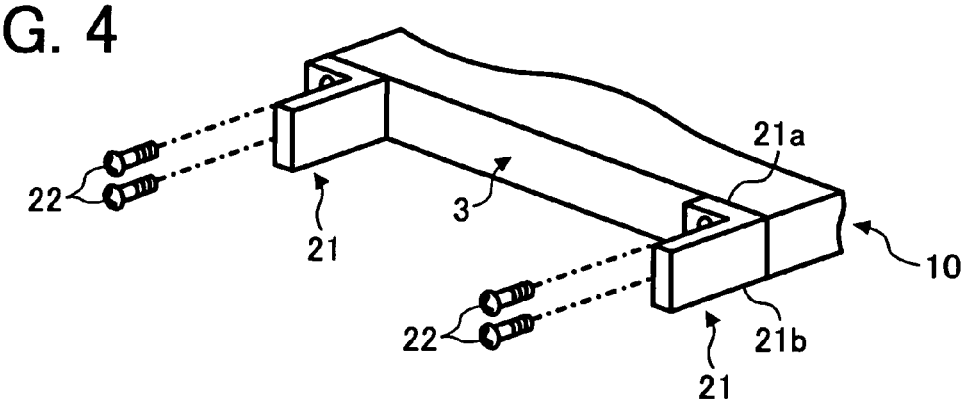
FIG. 4 is an exploded, partial, perspective view showing an embodiment of an image forming cartridge with a first type of handle.
Figure 5:
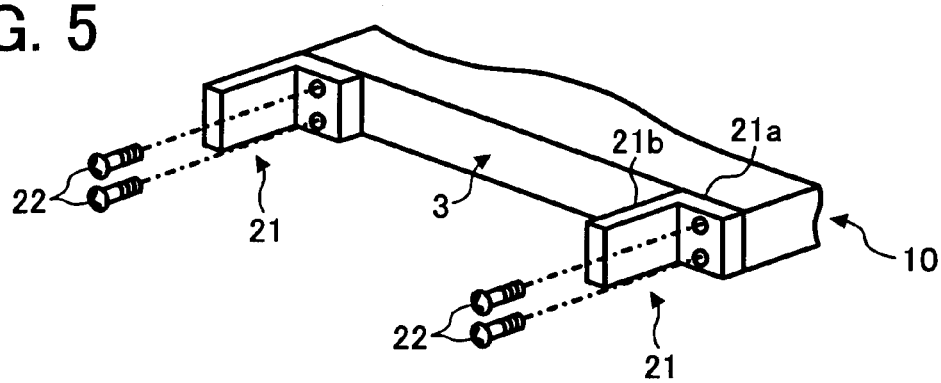
FIG. 5 is an exploded, partial, perspective view showing an embodiment of an image forming cartridge with a second type of handle.

Further, FIG. 4 and FIG. 5 show a preferable embodiment of an image forming cartridge 10 having two handles 21. The two handles are formed as other parts of a cartridge body 3 and are installed at each side on the cartridge body 3 by screws 22. Each handle 21 preferably has an installing portion 21*a* and a handling portion 21*b* so as to form an L-shaped character form. In such an embodiment, two handles 21 can be installed in a condition in which both of the handling portions 21*b* of each image forming cartridge 10 are on a right side of the handle, and both of the installing portions 21*a* are on the left side, as shown FIG. 4. Contrary, two handles 21 can be installed in a opposite installation, which both of the handling portions 21*b* of each image forming cartridge 10 are on the left side of the handle, and both of the installing portions 21*a* are on the right side, as shown FIG. 5. Further, each handle 21 can be easily replaced and changed to either orientation because by removing and reinstalling screws 22. Also, in the case that an image forming cartridge 10 is reused after the image forming cartridge is used up, the image forming cartridge 10 is easily reused at a lower cost because a handle 21 can be easily removed.

Next, another embodiment is explained as below, referring to FIG. 6 and FIG. 7. In situations in which a structure of this embodiment has almost the same structure as that of the first embodiment, the same reference numbers are used.

Figure 6:
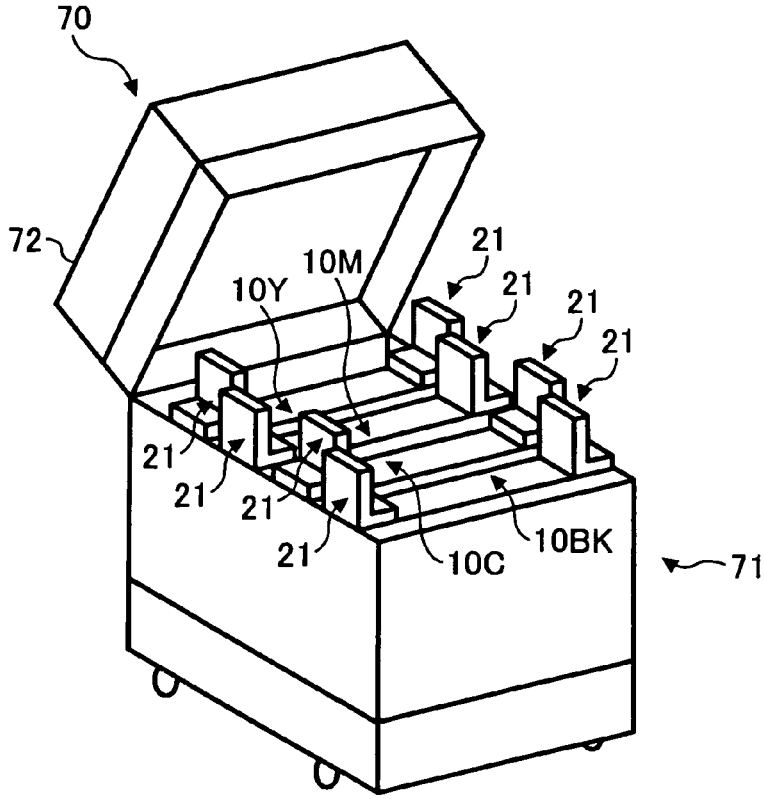
FIG. 6 is a perspective view showing another embodiment of an image forming apparatus horizontally mounting a plurality of image forming cartridges according to the present invention.
Figure 7:
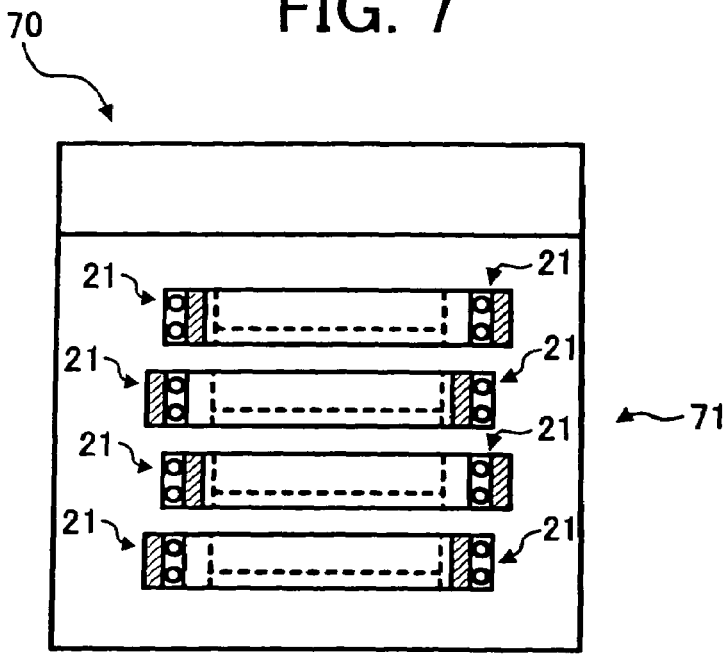
FIG. 7 is a top view showing the embodiment of an image forming apparatus shown in FIG. 6, which horizontally mounts a plurality of image forming cartridges in the apparatus.
Figure 8:
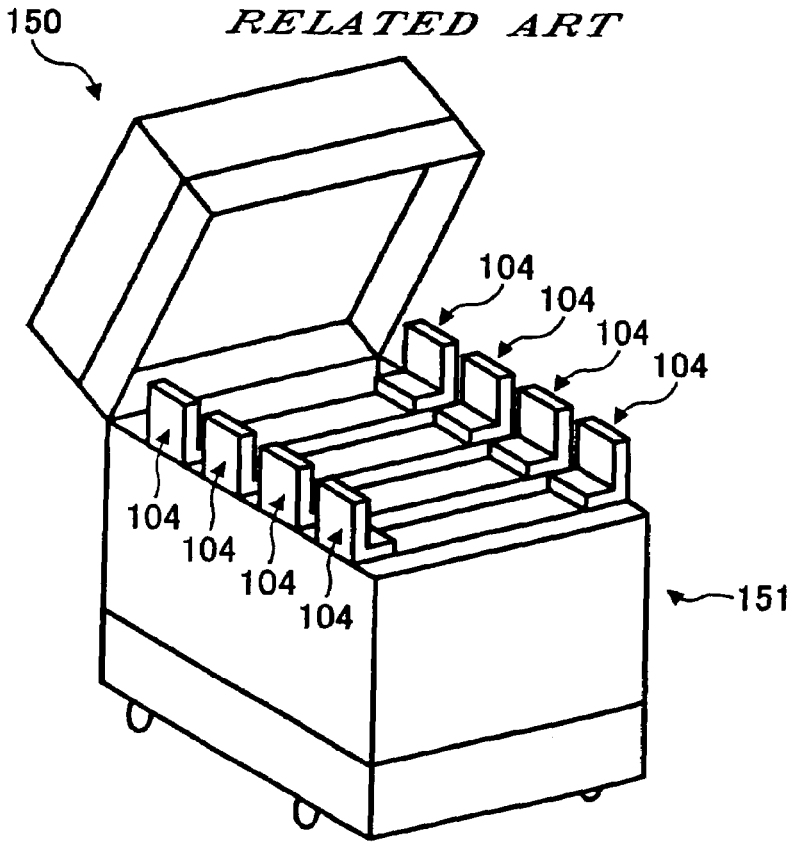
FIG. 8 RELATED ART
FIG. 8 is a perspective view showing an example of a related art image forming apparatus mounting a plurality of image forming cartridges in a horizontal direction.
Figure 9:
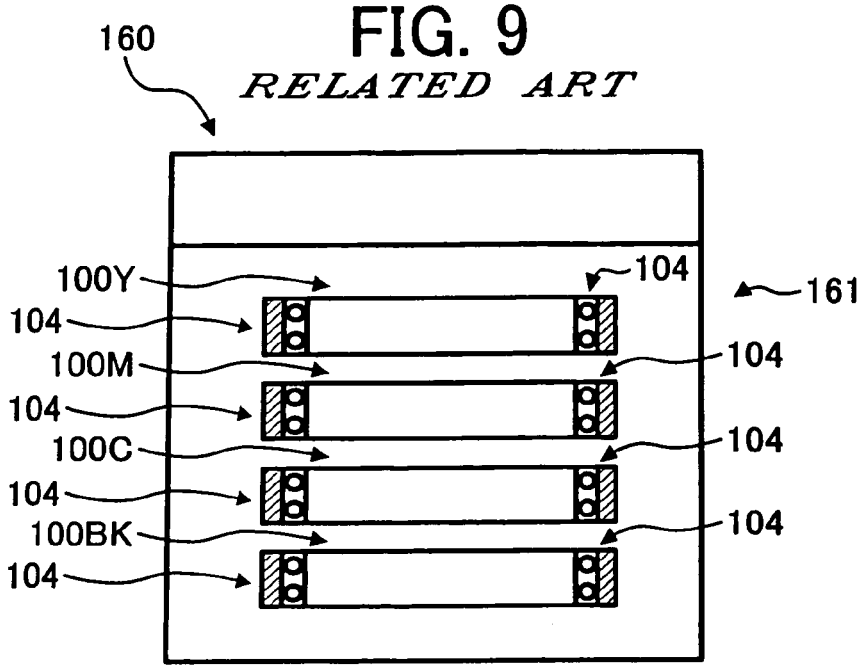
FIG. 9 RELATED ART
FIG. 9 is a top view showing the image forming apparatus as shown in FIG. 8, which mounts a plurality of image forming cartridges in a horizontal direction.
Figure 10:
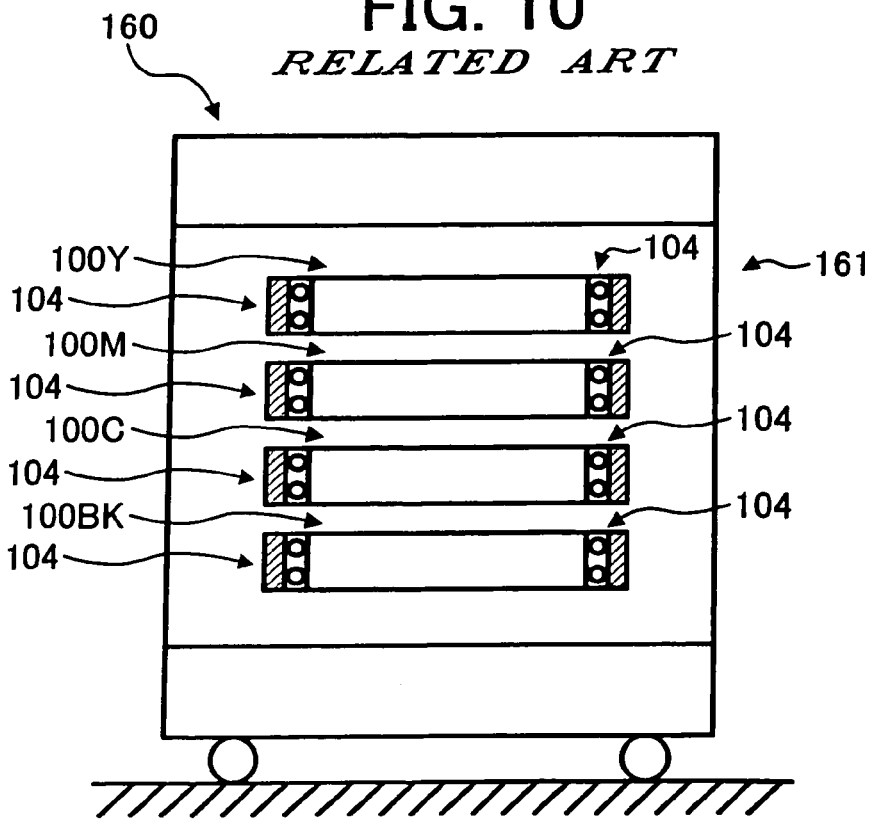
FIG. 10 RELATED ART
FIG. 10 is a side view showing another example of a related art image forming apparatus mounting a plurality of image forming cartridges in a vertical direction.
Figure 11:
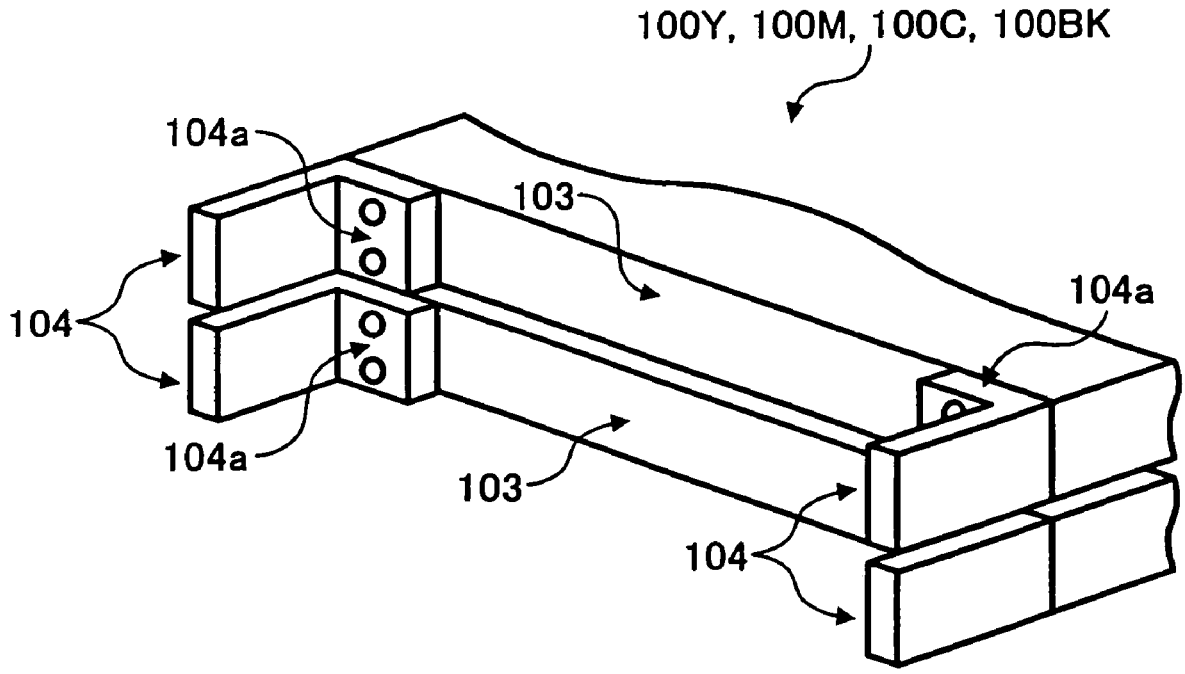
FIG. 11 RELATED ART
FIG. 11 is a partial, perspective view showing a related art image forming cartridge with handles.

FIG. 6 is a perspective drawing of an image forming apparatus 70 of another embodiment, which arranges a plurality of image forming cartridges 10BK, 10C, 10M, and 10Y in a horizontal direction. FIG. 7 is a top view of the image forming apparatus 70. Each image forming cartridge 10BK, 10C, 10M, and 10Y collectively includes a photoconductive drum 1 as an image bearing element, a developing device 5, a charging device 6 and a cleaning blade 7 as a cleaning device, in a cartridge body 3. Also, an image is formed on each photoconductive drum 1 in the same manner as in the first embodiment, and the image is transferred to paper or a sheet by a transferring device, and then is fixed on the paper or the sheet. The paper or the sheet will be discharged to a tray mounted side of the image forming apparatus.

Further, handles 21 are formed on cartridge bodies of image forming cartridges at an upper side of an image forming apparatus 70, in which a plurality of image forming cartridges can be replaced. In this embodiment, the handles 21 are alternately positioned as shown FIG. 6 and FIG. 7. Therefore, even if a plurality of image forming cartridges is mounted in a small pitch, the plurality of image forming cartridges can be easily grasped by a user when the image forming cartridge 10 has to be replaced. Also, since it is not necessary to have a lot of space for handling of the image forming cartridge, the image forming apparatus is downsized in a horizontal direction. Also, in the same manner as in the first embodiment, each handle 21 is formed as the other parts to a body of an image forming cartridge.

In all of embodiments disclosed above, each handle 21 of the plurality of image forming cartridges 10 is alternately positioned. However, it would be possible that a handle of image forming cartridge is installed at a different position with regard to a position of each handle for an adjacent image forming cartridge. In such an arrangement, even if a plurality of image forming cartridges is mounted in a small pitch, the plurality of image forming cartridges can be easily grasped by a user when the image forming cartridge has to be replaced. Also, since it is not necessary to have a lot of space for handling of the image forming cartridge, the image forming apparatus is downsized in a direction, in which a plurality of image forming cartridges is mounted.

Further, in all of embodiments disclosed above, a plurality of image forming cartridges is arranged in either of a vertical or horizontal direction. However, it is possible that a plurality of image forming cartridges can be arranged in an inclined direction.

Furthermore, all of embodiments disclosed above uses an electrostatic image transfer process to form an image. However, it is possible to apply the invention to a plurality of ink jet cartridges used by an ink jet type image forming apparatus.

The present invention relates to Japanese Patent Application No. 2004-026037, filed in Japan on Feb. 2, 2004, which is hereby incorporated by reference in its entirety.

The invention claimed is:

1. An image forming apparatus, comprising:

a plurality of image forming cartridges configured to mount to said image forming apparatus, said plurality of cartridges including a first image cartridge, a second image cartridge, and a third image cartridge;

said first image forming cartridge with a first handle; and said second image forming cartridge with a second handle, said third image forming cartridge with a third handle, wherein said plurality of image forming cartridges are mounted in a line, wherein said first and second handles are formed at different positions on said first and second image forming cartridges, and wherein said second and third handles are formed at different positions on said second and third image forming cartridges.

2. The apparatus as claimed in claim 1, wherein said first image forming cartridge is mounted adjacent to said second image forming cartridge.

3. The apparatus as claimed in claim 2, wherein said first handle and said second handle are offset from each other.

4. The apparatus as claimed in claim 1, wherein each of said first and second image forming cartridges includes an image bearing element.

5. The apparatus as claimed in claim 4, wherein each of said first and second image forming cartridges further includes at least a charging device configured to uniformly charge said image bearing element to a polarity, a developing device configured to develop a latent image on said image bearing element, and a cleaning device configured to remove a residual toner on said image bearing element.

6. The apparatus as claimed in claim 1, wherein said first and second image forming cartridges each include a toner bottle.

7. The apparatus as claimed in claim 6, wherein said first and second handles are installed on said first and second image forming cartridges in different directions.

8. The apparatus as claimed in claim 1, wherein said first and second image forming cartridges each include an ink cartridge.

9. The apparatus as claimed in claim 1, wherein said first and second handles are formed as detachable parts of said first and second image forming cartridges.

10. The apparatus as claimed in claim 1, wherein said first and second handles are installed at each side of a surface of said first and second image forming cartridges.

11. The apparatus as claimed in claim 1, wherein said first and second image forming cartridges are vertically mounted in said image forming apparatus.

12. The apparatus as claimed in claim 1, wherein said first and second image forming cartridges are horizontally mounted in said image forming apparatus.

13. The apparatus as claimed in claim 1, wherein said image forming apparatus configured to form an image by an electrostatic image transfer process.

14. The apparatus as claimed in claim 1, wherein said image forming apparatus is configured to form an image by an ink jet type image forming process.

15. An image forming cartridge configured to be mounted in an image forming apparatus using a plurality of image forming cartridges, said image forming cartridge comprising:

a cartridge body; and a handle on said cartridge body, wherein said handle is configured to be located at a different position from a handle of an adjacent image forming cartridge when said image forming cartridge is mounted in the image forming apparatus in a same orientation with respect to a reference plane as the plurality of image forming cartridges.

16. The image forming cartridge as claimed in claim 15, wherein said handle is formed as a detachable part of said image forming cartridge.

17. The image forming cartridge as claimed in claim 16, wherein said handle includes at least two handling members, which are mounted on a surface of said image forming cartridge in a same direction.

18. The image forming cartridge as claimed in claim 15, wherein said handle is installed at each side of a surface of said cartridge body.

19. An image forming apparatus, comprising:

a plurality of image forming cartridges configured to mount to said image forming apparatus, said plurality of cartridges including a first image cartridge and a second image cartridge;

said first image forming cartridge;

said second image forming cartridge;

first means for handling said first image forming cartridge; and second means for handling said second image forming cartridge formed at a different position from said first means for handling image forming cartridge, wherein said plurality of image forming cartridges are mounted in a same orientation with respect to a reference plane.

20. The apparatus claimed in claim 19, wherein said first means for handling includes means for mounting a first handle on a surface of the first image forming cartridge in a same orientation as a second handle on the surface of the first image forming cartridge.

21. The apparatus claimed in claim 19, further comprising means for forming an image on a recording medium.

22. An image forming cartridge configured to be mounted in an image forming apparatus using a plurality of image forming cartridges, said image forming cartridge comprising:

a cartridge body; and means for handling said image forming cartridge configured to be located at a different position corresponding to an adjacent image forming cartridge when said image forming cartridge is mounted in said image forming apparatus in a same orientation with respect to a reference plane as the plurality of image forming cartridges.

* * * * *